United States Patent [19]

Blazek et al.

[11] Patent Number: 4,728,258

[45] Date of Patent: Mar. 1, 1988

[54] TURBINE ENGINE COMPONENT AND METHOD OF MAKING THE SAME

[75] Inventors: William S. Blazek, Valley City; Jerry L. Hasch, Minerva, both of Ohio

[73] Assignee: TRW Inc., Cleveland, Ohio

[21] Appl. No.: 727,372

[22] Filed: Apr. 25, 1985

[51] Int. Cl.[4] ..... F01D 9/02

[52] U.S. Cl. ..... 415/137; 415/217; 164/35; 164/361; 164/516

[58] Field of Search ..... 164/516–519, 164/34, 35, 98, 361, 45; 415/216–218, 137, 138

[56] References Cited

U.S. PATENT DOCUMENTS

| | | | |
|---|---|---|---|
| 1,005,736 | 10/1911 | Wilkinson . | |
| 2,402,418 | 1/1943 | Kroon . | |
| 2,681,788 | 5/1951 | Wosika . | |
| 3,075,744 | 8/1960 | Peterson . | |
| 3,848,654 | 11/1974 | Boyle et al. | 164/34 |
| 4,008,052 | 2/1977 | Vishnevsky et al. | 29/194 |
| 4,195,396 | 4/1980 | Blazek | 164/516 X |
| 4,195,683 | 4/1980 | Blazek | 164/10 |
| 4,464,094 | 8/1984 | Gerken . | |
| 4,561,491 | 12/1985 | Slack | 164/516 |

OTHER PUBLICATIONS

Aerospace Propulsion Powerplants, pp. 576, 577, Cargnino & Karninen, 1967.

*Primary Examiner*—Robert E. Garrett
*Assistant Examiner*—Joseph M. Pitko
*Attorney, Agent, or Firm*—Tarolli, Sundheim & Covell

[57] ABSTRACT

To form a turbine engine component, metal airfoils are positioned in an annular array. Outer end portions of the airfoils are embedded in a wax outer shroud ring pattern and inner end portions of the airfoils are embedded in a wax inner shroud ring pattern. A mold is formed by covering the metal airfoils and the shroud ring patterns with ceramic mold material. The wax of the shroud ring patterns is then removed from the mold to leave inner and outer shroud ring mold ring cavities. The shroud ring mold cavities are filled with molten metal which is solidified to form inner and outer shroud rings interconnecting the airfoils. To accommodate thermal expansion of the airfoils relative to the shroud rings, a slip joint is provided between at least one end portion of each of the airfoils and a shroud ring. To enable the slip joint to be formed, molten metal solidifies in the shroud ring to be formed, molten metal solidifies in the shroud ring cavities free of metallurgical bonds to the airfoils. The shroud rings may be formed of metal having different compositions and crystallographic structures than the metal of the airfoils.

34 Claims, 15 Drawing Figures

FIG. 1
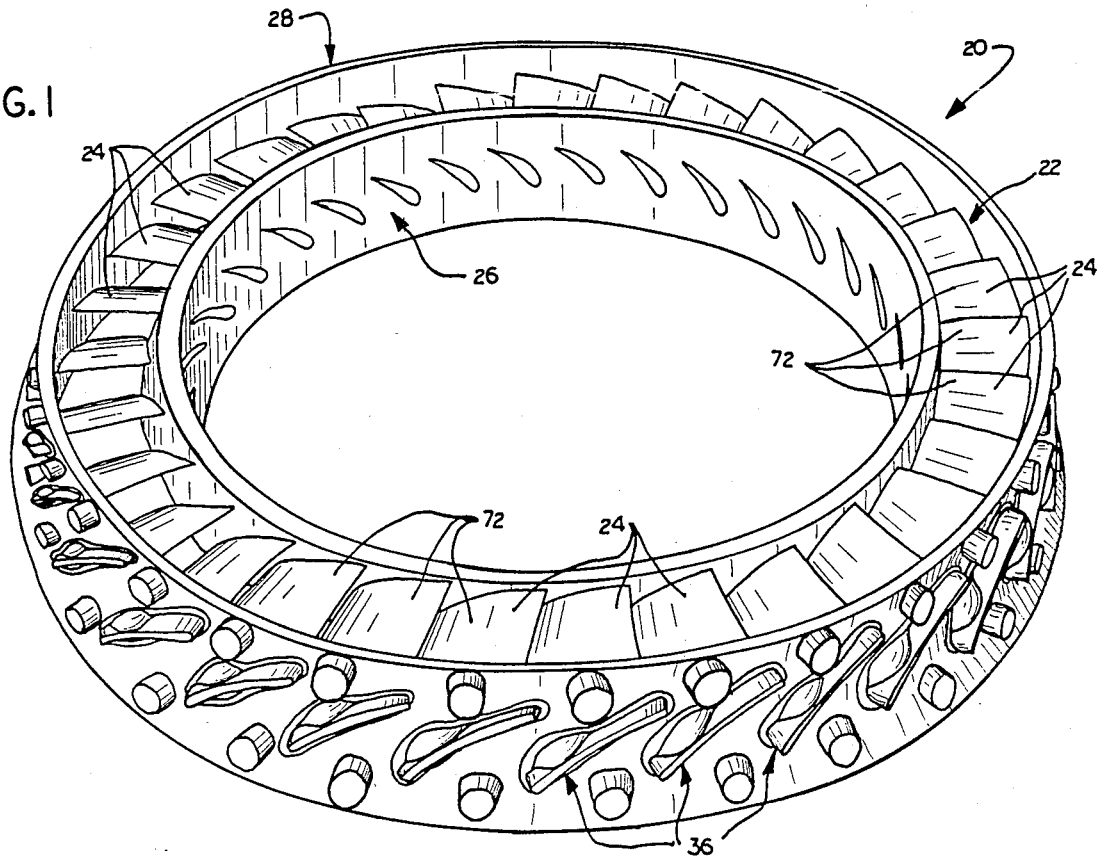
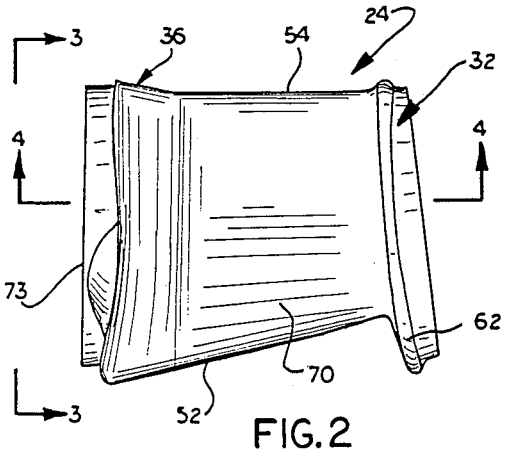
FIG. 2
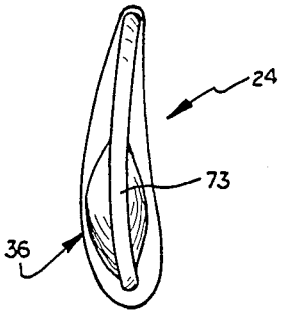
FIG. 3
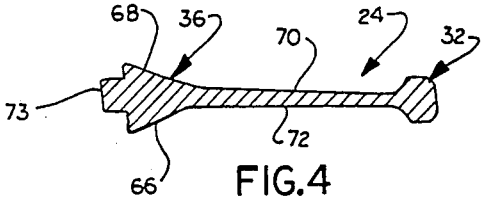
FIG. 4

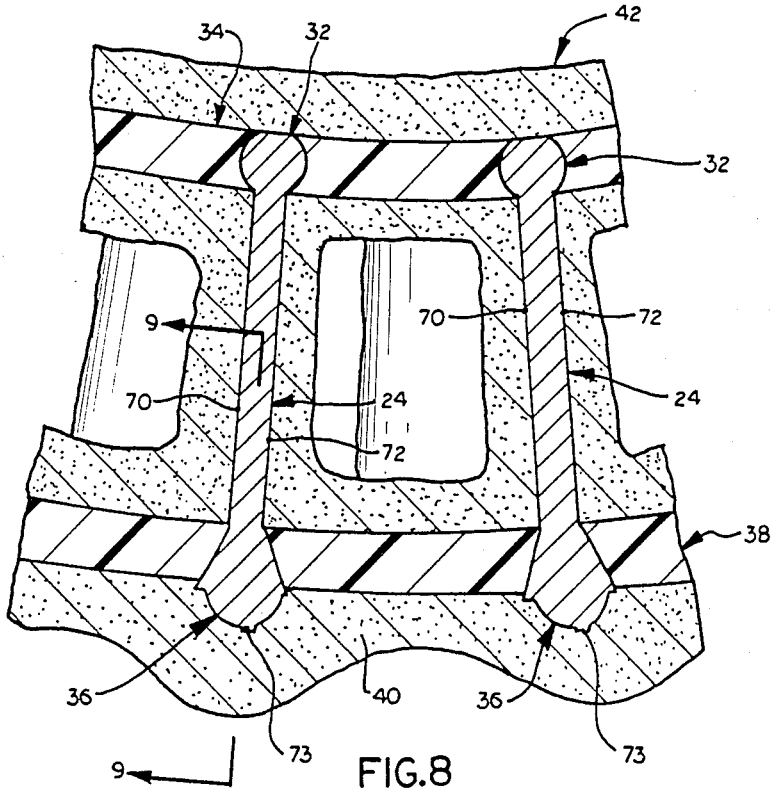
FIG.8
FIG.9
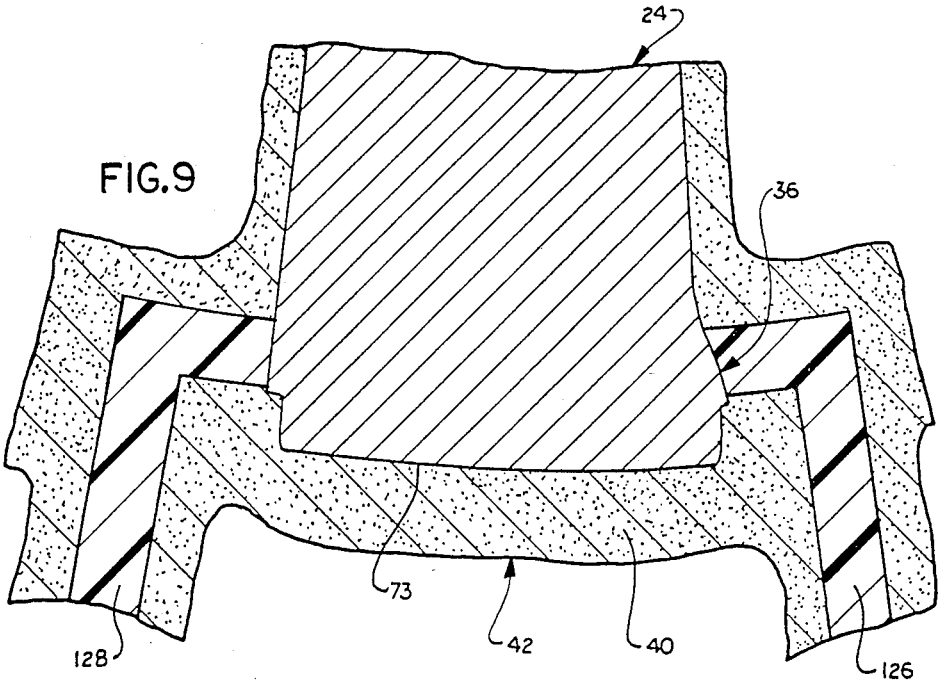

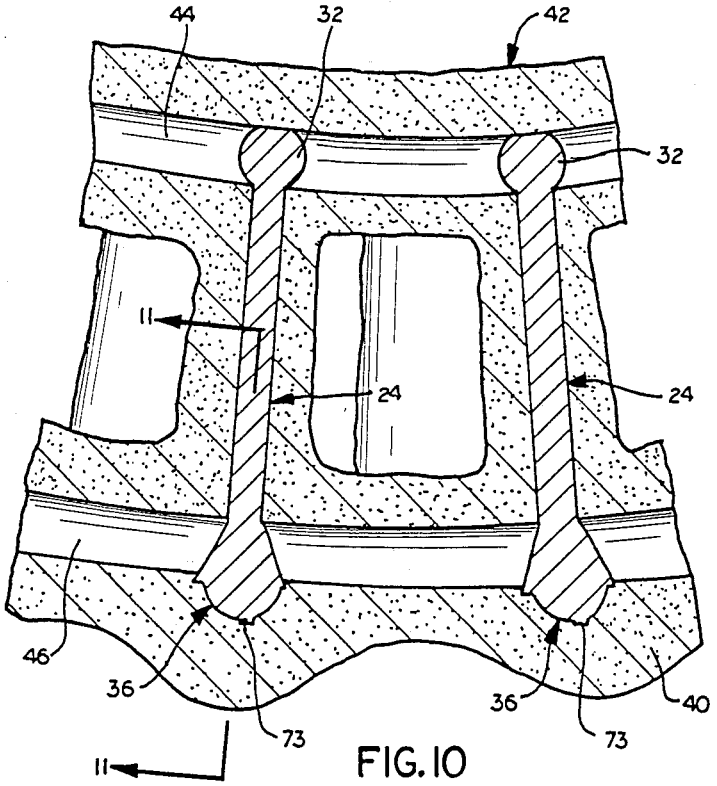
FIG. 10
FIG. 11
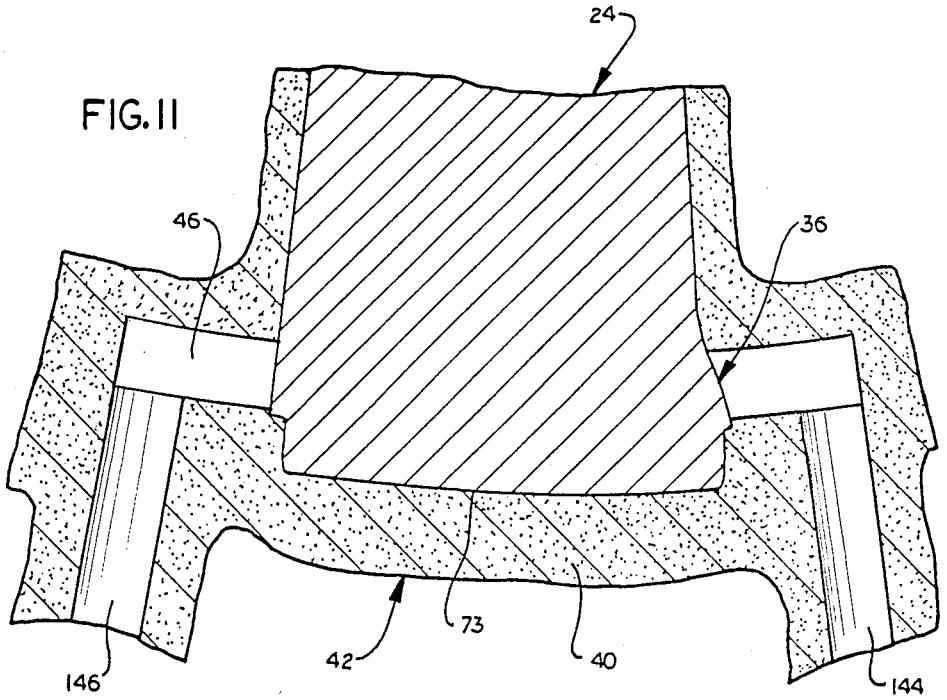

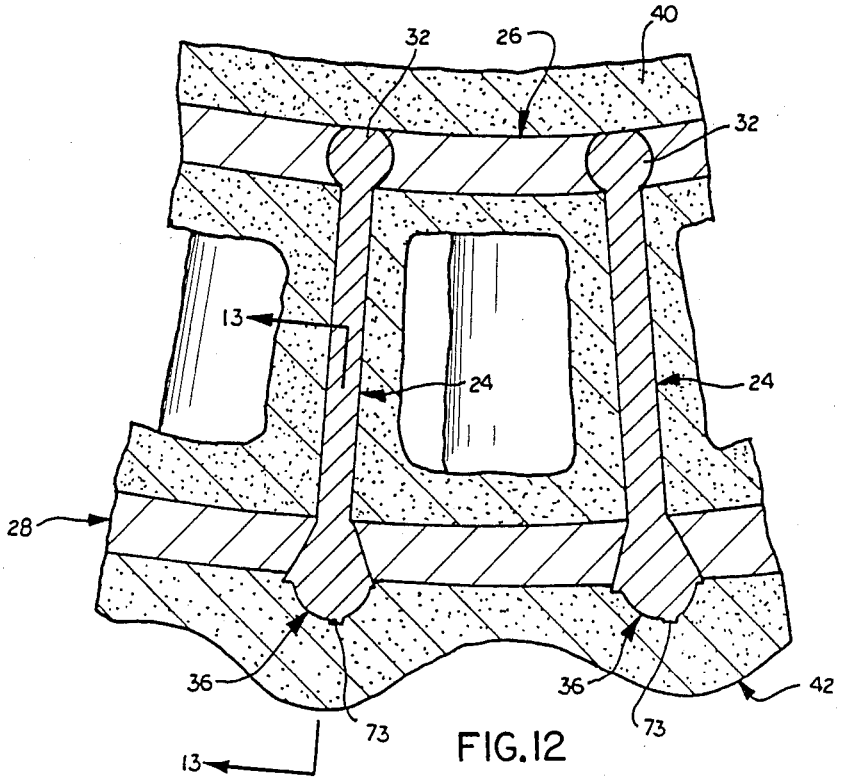
FIG. 12
FIG. 13
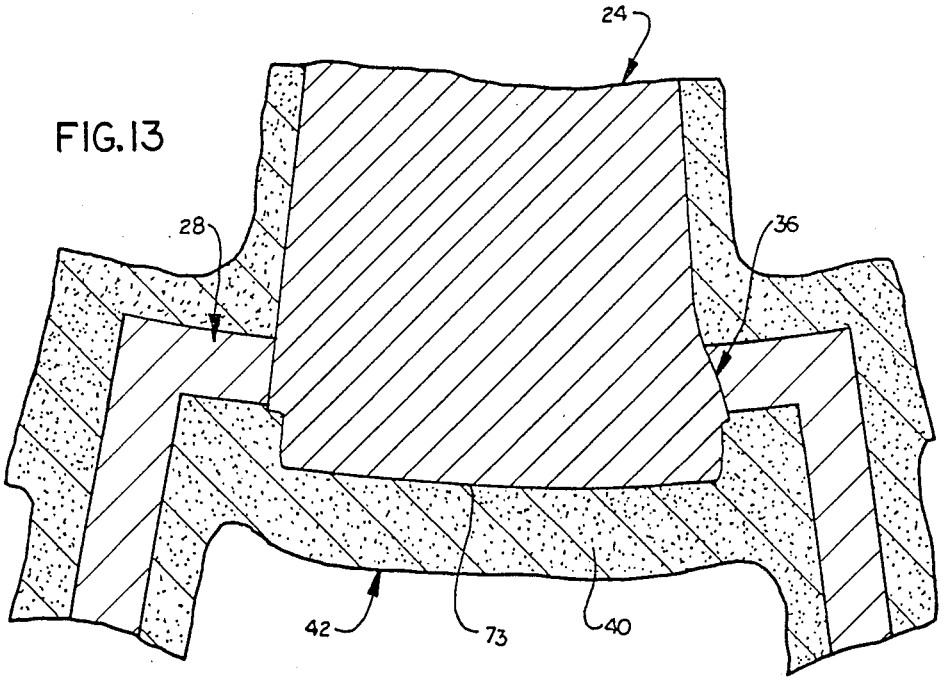

TURBINE ENGINE COMPONENT AND METHOD OF MAKING THE SAME

BACKGROUND OF THE INVENTION

The present invention relates to a new and improved turbine engine component and the method by which it is made. Specifically, the present invention relates to a turbine engine component having a plurality of airfoils disposed in an annular array between inner and outer shroud rings.

Turbine engines commonly include a stator which is having airfoils or vanes which direct a flow of high temperature gases against the blades of a rotor. In order to withstand severe operating conditions, it has been suggested in U.S. Pat. No. 4,464,094 that turbine engine components could be constructed with airfoils having either a single crystal or columnar grained crystallographic structure. The airfoils shown in this patent extend between shroud rings having single crystal or columnar grained crystallographic structures with a growth direction transverse to the leading and trailing edges of the airfoils.

In U.S. Pat. No. 4,464,094, the shroud rings are cast in segments separately from the airfoils. The airfoils are then connected to the shroud ring segments by a brazing operation. In U.S. Pat. Nos. 4,008,052 and 4,195,683, molten metal is solidified around end portions of preformed airfoils.

In order to minimize thermal stresses in turbine engine components, it has been suggested in U.S. Pat. No. 3,075,744 that the outer ends of the airfoils be movable relative to an outer shroud ring to accommodate thermal expansion of the airfoils. The inner ends of the airfoils are anchored to an inner shroud ring. The outer ends of the airfoils are connected with the outer shroud ring at slip joints.

BRIEF SUMMARY OF THE INVENTION

The present invention relates to a new and improved method of making an improved turbine engine component having a plurality of airfoils disposed in an annular array between inner and outer shroud rings. In practicing the method of making the turbine engine component, airfoils are placed in an annular array with the end portions of the airfoils embedded in wax inner and outer shroud ring patterns. After a wax gating pattern has been connected with the wax shroud ring patterns, the entire assembly is covered with ceramic material to form a mold. The wax of the shroud ring and gating patterns is then removed to leave inner and outer shroud ring mold cavities in which the inner and outer end portions of the airfoils are disposed.

The inner and outer shroud ring mold cavities are then filled with molten metal which encloses the end portions of the airfoils. During the filling of the shroud ring mold cavities with molten metal, the airfoils are held in a selected spatial relationship with the shroud ring mold cavities by the ceramic mold material. Once the molten metal in the inner and outer shroud ring mold cavities has solidified, the turbine engine component is removed from the mold.

In order to minimize thermal stresses during use of the turbine engine component, slip joints are provided between the airfoils and a shroud ring to accommodate thermal expansion of the airfoils relative to the shroud rings. Thus, one end of each of the airfoils is anchored in one of the shroud rings while slip joints are provided between the airfoils and the other shroud ring. When the airfoils are heated to a temperature above the temperature of the shroud rings, thermal expansion of the airfoils causes the slip joints to open.

In order to optimize the operating characteristics of the turbine engine component, the shroud rings and airfoils may be formed of metals having different compositions and different crystallographic structures. Thus, the shroud rings may be formed of a metal which is different than the metal of the airfoils. Also, the shroud rings may be formed of different metals which are both different than the metal of the airfoils. The airfoils may be formed with either a single crystal or columnar grained crystallographic structure.

BRIEF DESCRIPTION OF THE DRAWINGS

The foregoing and other objects and features of the present invention will become more apparent upon a consideration of the following description taken in connection with the accompanying drawings wherein:

FIG. 1 is a pictorial illustration of a turbine engine component constructed in accordance with the present invention;

FIG. 2 is a plan view of a metal airfoil used in the turbine engine component of FIG. 1;

FIG. 3 is an end view, taken generally along the line 3—3 of FIG. 2, further illustrating the construction of the airfoil;

FIG. 4 is a sectional view, taken generally along the line 4—4 of FIG. 2, illustrating the configuration of inner and outer end portions of the airfoil;

FIG. 8 is a fragmentary sectional view illustrating the manner in which ceramic mold material covers the airfoils and shroud ring patterns;

FIG. 9 is a fragmentary sectional view, taken generally along the line 9—9 of FIG. 8, illustrating the manner in which the ceramic mold material overlies portions of a gating pattern connected with the outer shroud ring pattern;

FIG. 10 is a fragmentary sectional view illustrating the relationship between the metal airfoils and shroud ring mold cavities formed by removing the shroud ring patterns of FIG. 8;

FIG. 11 is an elevational sectional view, taken generally along the line 11—11 of FIG. 10, illustrating the manner in which gating passages are connected in fluid communication with upper and lower portions of the outer shroud ring mold cavity;

FIG. 12 is a fragmentary sectional plan view illustrating the relationship between the airfoils and inner and outer shroud rings cast in the shroud ring mold cavities of FIG. 10;

FIG. 13 is a fragmentary sectional view, taken generally along the line 13—13 of FIG. 12, illustrating the relationship between an airfoil, outer shroud ring, and metal which has solidified in gating passages;

DESCRIPTION OF SPECIFIC PREFERRED EMBODIMENTS OF THE INVENTION

General Description

Figure 5:
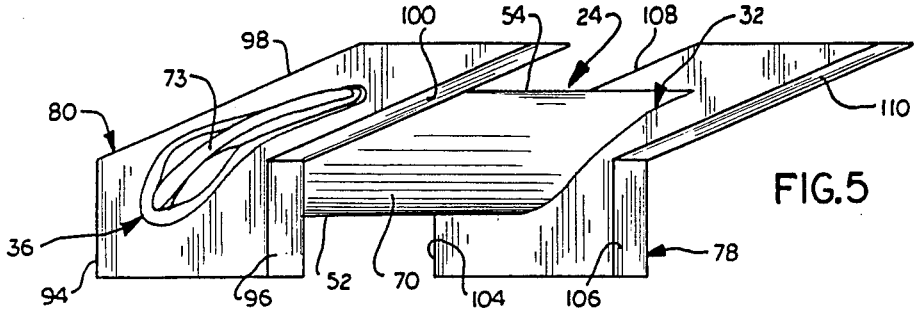
FIG. 5 is a pictorial illustration of the metal airfoil of FIG. 2 with segments of wax shroud ring patterns connected with opposite ends of the airfoil.

A turbine engine component 20 constructed in accordance with the present invention is illustrated in FIG. 1. In the present instance, the turbine engine component 20 is a stator which will be fixedly mounted between the combustion chamber and first stage rotor of a turbine engine. The hot gases from the combustion chamber are directed against an annular array 22 of airfoils or vanes 24 which extend between a circular inner shroud ring 26 and a circular outer shroud ring 28. Although it is believed that the turbine engine component 20 constructed in accordance with the present invention will be particularly advantageous when used between the comhustion chamber and first stage rotor of a turbine engine, it should be understood that turbine engine components constructed in accordance with the present invention can be used at other locations in an engine.

In accordance with a feature of the present invention, the airfoils 24 are formed separately from the inner and outer shroud rings 26 and 28. This allows the airfoils 24 to be formed of metal and/or ceramic materials which can withstand the extremely high operating temperatures to which they are exposed in the turbine engine. Since the shroud rings 26 and 28 are subjected to operating conditions which differ somewhat from the operating conditions to which the airfoils 24 are subjected, the shroud rings 26 and 28 can advantageously be made of materials which are different from the materials of the airfoils 24.

The airfoils 24 (FIGS. 2–4) are formed separately from the shroud rings 26 and 28. In the present instance, the airfoils 24 are cast as a single crystal of a nickel-chrome superalloy metal. The airfoils 24 may be cast by a method generally similar to that disclosed in U.S. Pat. No. 3,494,709. However, it should be understood that the airfoils 24 could be formed with a different crystallographic structure and/or of a different material if desired. For example, it is contemplated that the airfoils 24 could have a columnar grained crystallographic structure or could be formed of a ceramic or metal and ceramic material if desired.

To fabricate the turbine engine component 20, an inner end portion 32 of the metal airfoil 24 is embedded in a wax inner shroud ring pattern 34 (see FIG. 8). Similarly, an outer end portion 36 of each of the metal airfoils 24 is embedded in a wax outer shroud ring pattern 38. The airfoils 24 and wax inner and outer shroud ring patterns 34 and 38 are covered with ceramic mold material 40 to form a mold 42.

The wax material of the shroud ring patterns 34 and 38 is then removed from the mold 42 to leave a pair of circular shroud ring mold cavities 44 and 46. The shroud ring mold cavities 44 and 46 extend completely around the inner and outer end portions 32 and 36 of the airfoils 24. However, the end surfaces of the outer end portions 36 of the airfoils 24 are covered by the ceramic mold material 40 (FIGS. 10 and 11).

The shroud ring mold cavities 44 and 46 are then filled with molten metal. The molten metal solidifies to form inner and outer shroud rings 26 and 28. As the molten metal solidifies, the airfoils 24 act as chills to promote solidification of the molten metal of the shroud rings in a direction which is transverse to the leading and trailing edges 52 and 54 (FIG. 2) of the airfoils 24.

An oxide covering forms over the metal airfoils 24 during processing of the airfoils. The oxide covering inhibits the formation of metallurgical bonds between the airfoils 24 and shroud rings 26 and 28. Thus, there is only a mechanical interconnection between the shroud rings 26 and 28 and the airfoils 24.

Since the shroud rings 26 and 28 are cast separately from the airfoils 24, the shroud rings can be formed of a metal which is different than the metal of the airfoils 24. Thus, in the specific instance described herein, the airfoils 24 were cast as single crystals of a nickel-chrome superalloy while the inner and outer shroud rings 26 and 28 were formed of a cobalt chrome superalloy, such as MAR M509. Although the inner and outer shroud rings 26 and 28 were cast of the same metal, it is contemplated that the inner shroud ring 26 could be cast of one metal and the outer shroud ring 28 cast of another metal. The airfoils 24 would be formed of a third metal or ceramic material in order to optimize the operating characteristics of the turbine engine component 20.

During operation of a turbine engine, the airfoils 24 will be heated to higher temperatures than the inner and outer shroud rings 26 and 28. Due to the fact that the airfoils 24 are heated to a higher temperature than the shroud rings 26 and 28, there will be greater thermal expansion of the airfoils 24 than the shroud rings. In accordance with a feature of the present invention, slip joints 58 (see FIG. 14) are provided between the outer shroud ring 28 and the outer end portion 36 of each of the airfoils 24 to accommodate thermal expansion of the airfoils. Although the slip joints 58 have been shown as being between the outer shroud ring 28 and the airfoils 24, the slip joints 58 could be between the inner shroud ring 26 and airfoils if desired.

The inner end portion 32 of each of the airfoils 24 is anchored in and held against axial movement relative to the inner shroud ring 26. Therefore, upon heating of the airfoils 24 to a temperature which is above the temperature of the shroud rings 26 and 28, each airfoil 24 expands radially outwardly and opens a slip joint 58 (FIG. 15) between the outer end portion 36 of the airfoil and the outer shroud ring 28. By opening the slip joints 58 in the manner illustrated in FIG. 15, the application of thermal stresses to the airfoils 24 is avoided. Since there are no metallurgical bonds between the airfoils 24 and the outer shroud ring 28, the slip joint 58 are readily opened with the application of a minimum of stress to the airfoils.

Airfoil

Each of the identical airfoils 24 (FIG. 2) has a relatively wide inner end portion 32. Thus, the inner end portion 32 has a flange section 62 which extends outwardly from the leading edge portion 52 of the airfoil. The outwardly projecting flange section 62 provides for a mechanical interconnection between the airfoil 24 and the inner shroud ring 26 throughout a substantial arcuate distance along the shroud ring 26. In addition, the inner end portion 32 of the airfoil has a bulbous configuration to provide for a mechanical interlocking between the inner shroud ring 26 and the inner end portion 32 of the airfoil 24. Due to the mechanical connection between the inner end portion 32 of the airfoil 24 and the inner shroud ring 26, the inner end portion 32 of each airfoil 24 is anchored and cannot move radially outwardly of the inner shroud ring.

Figure 14:
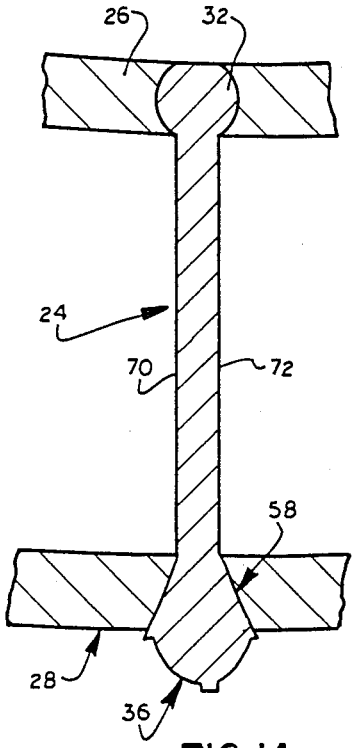
FIG. 14 is (on sheet 2 of the drawings) is a schematic sectional view illustrating the relationship between an airfoil and the inner and outer shroud rings when the airfoil and shroud rings are at the same temperature.

The outer end portion 36 of the airfoil 24 is tapered inwardly from the outer shroud ring 28 toward the inner shroud ring 26 (see FIGS. 4 and 14). Thus, the outer end portion 36 of the airfoil 24 has a pair of sloping side surface areas 66 and 68 which slope radially inwardly to a concave major side surface 70 and a convex major side surface 72. In addition, the outer edge portion 36 of the airfoil 24 has an end section 73. The end section 73 and side surfaces 70 and 72 engage the ceramic mold material 40 (FIGS. 8 and 9) to firmly anchor the airfoil 24 in place in the mold 42.

Shroud Ring Pattern Segments

The wax shroud ring patterns 34 and 38 (FIGS. 7 and 8) are formed by interconnecting inner and outer shroud ring pattern segments 78 and 80 (FIG. 5). The wax inner shroud ring pattern segment 78 is connected with the inner end portion 32 of the airfoil 24. The wax outer shroud ring pattern segment 80 is connected with the outer end portion 36 of the airfoil 24.

To mount the wax pattern segments 78 and 80 on the inner and outer end portions 32 and 36 of the airfoil 24, the airfoil is positioned with its inner and outer end portions 32 and 36 extending into die cavities. The die cavities have a configuration corresponding to the configuration of the pattern segments 78 and 80. Hot wax is then injected into the die cavities. The hot wax solidifies to form the pattern segments 78 and 80.

The hot wax which is used to form the pattern segments 78 and 80 can be either a natural wax or an artificial substance having characteristics which are generally similar to natural waxes. Thus, the wax used to form the pattern segments 78 and 80 could be a polymeric material such as polystyrene.

The inner wax pattern segment 78 extends completely around the inner end portion 32 of the airfoil 24 and almost completely encloses the inner end of the airfoil. The outer wax pattern segment 80 extends completely around the outer end portion 36 of the airfoil 24. However, the outer end 73 of the airfoil 24 is exposed. Since the side surfaces 66 and 68 on the outer end portion 36 of the airfoil 24 taper inwardly (see FIG. 15), the exposed outer end 73 of the airfoil 24 has a greater cross sectional area in a plane perpendicular to a central axis of the airfoil than any other cross section of the outer end portion of the airfoil.

Wax Pattern Assembly

In order to cast the inner and outer shroud rings 26 and 28, a pattern assembly 88 (FIG. 7) is fabricated. The pattern assembly includes the wax inner shroud ring pattern 34, the wax outer shroud ring pattern 38, and wax gating pattern 90. The wax gating pattern 90, like the shroud ring patterns 34 and 38, can be formed of either a natural wax or an artificial substance having characteristics which are generally similar to natural waxes.

The wax inner and outer shroud ring patterns 34 and 38 are formed by positioning the wax pattern segments 78 and 80 (FIG. 5) in abutting engagement. The inner wax pattern segments 78 are curved so as to form a segment of the annular inner shroud ring pattern 34. Similarly, the outer wax pattern segments 80 are curved to form a segment of the annular outer shroud ring pattern 38.

In the illustrated turbine engine component 20, there are thirty-one airfoils 24 in the circular array 22 (FIGS. 1 and 7) of airfoils. In this instance, each of the wax pattern segments 78 and 80 (FIG. 5) has an arcuate extent corresponding to approximately 11.6 degrees of a shroud ring pattern 34 or 36. Of course, the arcuate extent of the wax pattern segments 78 and 80 will depend upon the specific number of airfoils 24 provided in the annular array 22 of airfoils.

Figure 6:
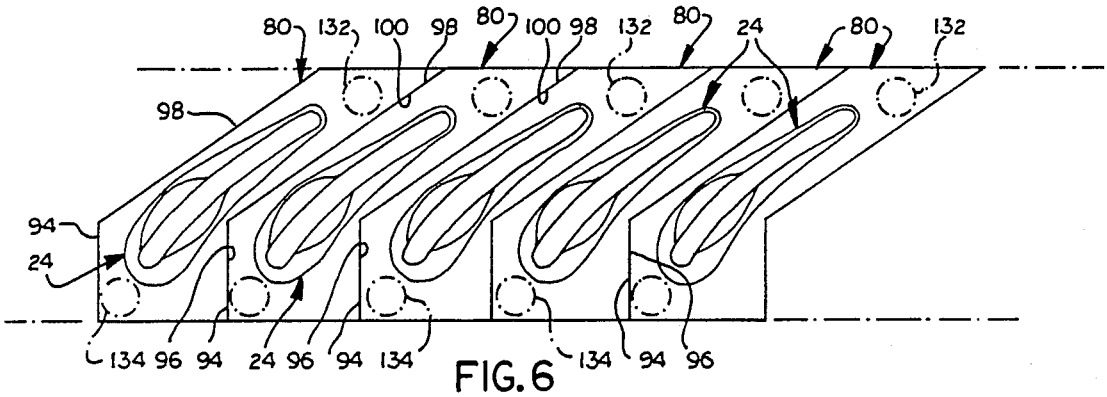
FIG. 6 is a schematic elevational view depicting the manner in which segments of an outer shroud ring pattern are placed in abutting engagement to position airfoils relative to each other.

To form the outer shroud ring pattern 38, an upright leading end 94 (FIG. 5) of each of the outer shroud ring pattern segments 80 is positioned in abutting engagement with an upright trailing end 96 of an adjacent outer shroud ring pattern segment 80 (FIG. 6). In addition, an upwardly sloping leading side 98 on the outer shroud ring pattern segment 80 (FIG. 5) is positioned in abutting engagement with a trailing upwardly sloping side 100 of an adjacent outer shroud ring pattern segment (FIG. 6). When the surfaces 94, 96, 98 and 100 on the outer shroud ring pattern segments 80 have been positioned in abutting engagement in the manner shown in FIG. 6, the shroud ring pattern segments 80 form a circular ring having a configuration corresponding to the desired configuration of the outer shroud ring 28.

Simultaneously with the placing of the outer shroud ring segments 80 in engagement, the inner shroud ring segments 78 are placed in abutting engagement. Thus, the outer shroud ring wax pattern segment 78 (FIG. 5) has an upright leading end 104 and an upright trailing end 106 (FIG. 5). The inner shroud ring pattern segment 78 also has sloping leading and trailing sides 108 and 110. The sides 104, 106, 108 and 110 (FIG. 5) of the inner shroud ring pattern segments 78 are placed in abutting engagement with adjacent inner shroud ring pattern segments.

Once the inner and outer shroud ring pattern segments 78 and 80 have been positioned in abutting engagement, the shroud ring pattern segments are interconnected with a suitable adhesive or hot wax to securely interconnect the shroud ring pattern segments and form the inner and outer wax shroud ring patterns 34 and 38. The airfoils 24 extend between the coaxial inner and outer wax shroud ring patterns 34 and 38 in a radial direction.

Figure 7:
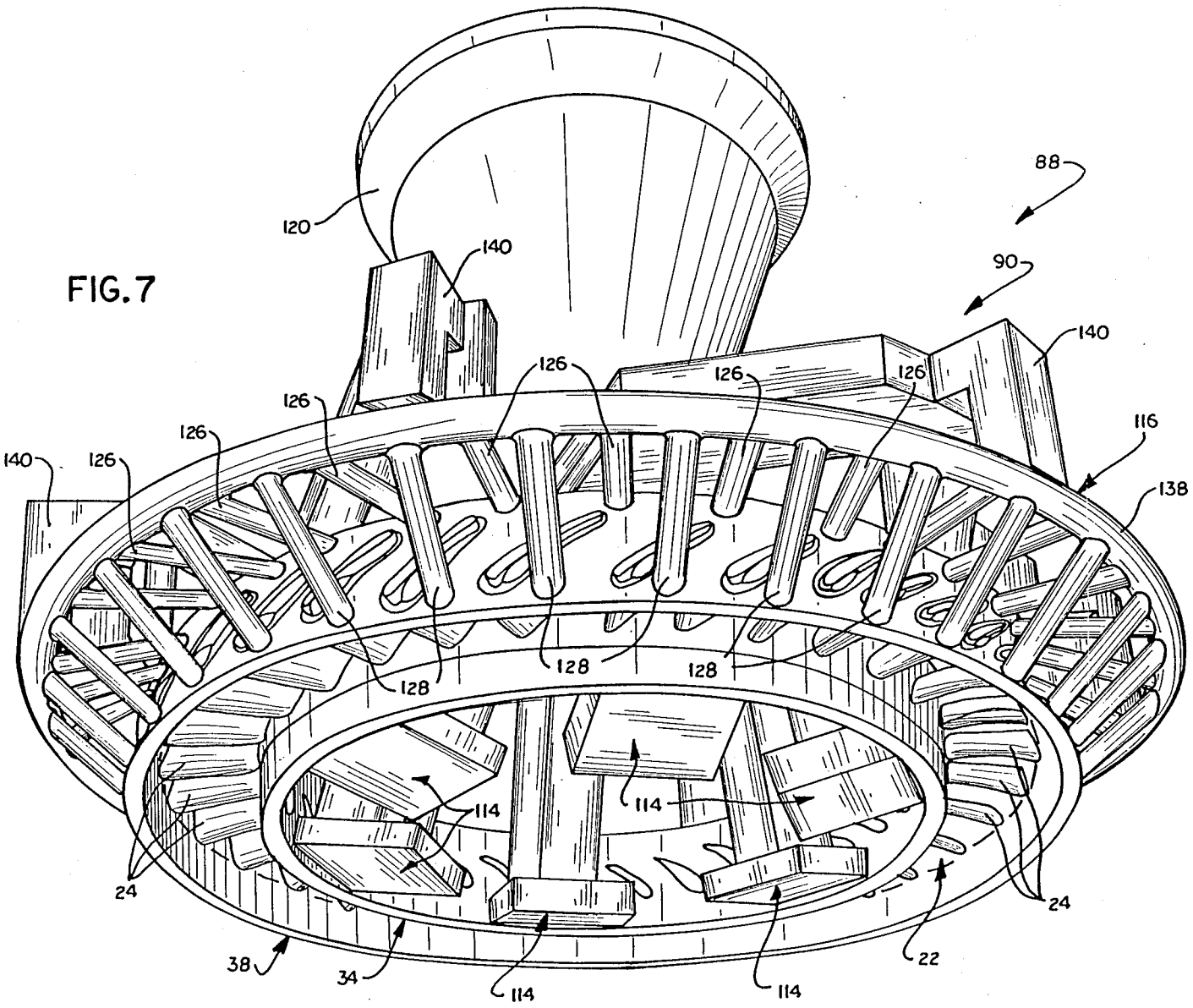
FIG. 7 is a pictorial illustration of an annular array of the metal airfoils of FIG. 2 connected with wax gating and shroud ring patterns.

After the shroud ring pattern segments 78 and 80 have been interconnected to form the inner and outer shroud ring wax patterns 34 and 38, the wax gating pattern 90 is connected with the shroud ring wax patterns. Thus, identical interior wax gating patterns 114 are connected with the radially inner side of the inner shroud ring wax pattern 34 (FIG. 7). Similarly, an annular exterior wax gating pattern 116 is connected with the radially outer side of the outer shroud ring wax pattern 38. The interior wax gating patterns 114 and exterior wax gating patterns 116 are connected with a wax downpole and pour cup pattern 120.

During pouring of molten metal into the inner and outer shroud ring mold cavities 44 and 46 (FIG. 10), the airfoils 24 act as chills so that the molten metal tends to solidify outwardly from the airfoils 24 toward the upper and lower end portions of the inner and outer shroud ring mold cavities 44 and 46. This directional solidification of the molten metal in the inner and outer shroud ring mold cavities 44 and 46 enhances the operating characteristics of the inner and outer shroud rings 26 and 28. However, chilling effect of the airfoils 24 results in the molten metal between adjacent airfoils 24 solidifying before the molten metal in the axially outer end portions of the shroud ring mold cavities 44 and 46.

In order to prevent the formation of shrinkage defects in the outer shroud ring 28, the exterior wax gating pattern 116 is connected with the axially upper end portion of the outer shroud ring pattern 38 by upper wax gating arms 126. Similarly, the exterior wax gating pattern 116 is connected with the lower portion of the outer shroud ring pattern 38 by lower wax gating arms 128. The connections between the upper wax gating arms 126 and the upper end portion of the outer shroud pattern 38 have been indicated by the dashed circles 132 in FIG. 6. Similarly, the connections between the lower wax gating arms 128 and the lower portion of the shroud ring pattern 38 have been indicated by circles 134 in FIG. 6.

The gating arms 126 and 128 are connected with and extend radially inwardly from a circular wax gating ring pattern 138 which circumscribes the outer shroud ring pattern 38. The gating ring pattern 138 is connected with the downpole and pour cup 120 by wax gating patterns 140. It should be noted that the wax gating patterns 140 are also connected directly to the upper end portion of the outer shroud ring pattern 38.

The inner end portions 32 of the airfoils 24 extend into the outer shroud ring mold cavity 44 and promote solidification of the molten metal in a direction away from the end portions of the airfoils in the same manner as previously explained in connection with the inner shroud ring mold cavity 46. Therefore, the interior wax gating patterns 114 are connected with both the axially upper and lower end portions of the inner shroud ring mold cavity 44 to prevent the formation of shrinkage defects. The interior wax gating patterns 114 are also connected directly to the wax downpole and pour cup pattern 120.

Once the pattern assembly 88 (FIG. 7) has been completed, it is covered with a suitable mold material. The mold material solidifies over the outside of the wax patterns 34, 38 and 90 and, upon removal of the material of the wax patterns, forms a mold having cavities with configurations corresponding to the configuration of the wax pattern assembly 88.

Molding Shroud Rings

In order to form a mold 42, the entire pattern assembly 88 (FIG. 7) is completely covered with liquid ceramic mold material. The ceramic mold material 40 (FIG. 8) completely covers the exposed surfaces of the metal airfoils 24, wax inner shroud ring 34, wax outer shroud ring 38 and wax gating pattern 90. The entire pattern assembly 88 may be covered with the liquid ceramic mold material by repetitively dipping the pattern assembly in a slurry of liquid ceramic mold material.

Although many different types of slurries of ceramic mold material could be utilized, one illustrative slurry contains fused silica, zircon, and other refractory materials in combination with binders. Chemical binders such as ethalsilicate, sodium silicate and colloidal silica can be utilized. In addition, the slurry may contain suitable film formers, such as alginates, to control viscosity and wetting agents to control flow characteristics and pattern wettability.

In accordance with common practices, the initial slurry coating applied to the pattern assembly 88 may contain a finely divided refractory material to produce an accurate surface finish. A typical slurry for a first coat may contain approximately 29% colloidal silica suspension in the form of a 20% to 30% concentrate. Fused silica of a particle size of 325 mesh or smaller in an amount of 71% can be employed together with less than 1%–10% by weight of a wetting agent. Generally, the specific gravity of the ceramic mold material may be on the order of 1.75 to 1.80 and have a viscosity of 40 to 60 seconds when measured with a Number 5 Zahn cup at 75° to 85° F. After the application of the initial coating, the surface is stuccoed with refractory materials having particle sizes on the order of 60 to 200 mesh. Although one known specific type of ceramic mold material has been described, other known types of mold materials could be used if desired.

The ceramic mold material 40 (FIG. 8) overlies and is in direct engagement with the major side surfaces 70 and 72 of the metal airfoils 24. In addition, the mold material overlies the exposed end 73 of the airfoils 24 (see FIGS. 8 and 9). Due to the inwardly tapered configuration of the end portions 36 of the airfoils 24, the ceramic mold material overlies the end portions where their cross sectional areas are a maximum.

Although the ends 73 of the airfoils have been shown as protruding outwardly, it is contemplated that the ends 72 of the airfoils could extend generally parallel to the side surface of the outer shroud ring pattern 38 if desired. Where weight saving is important, it is believed that the end portion 72 of the airfoils will be trimmed to eliminate any excess metal.

The ceramic mold material 40 completely encases the inner and outer shroud ring patterns 34 and 38 (FIG. 8). In addition, the ceramic mold material 40 overlies the wax gating pattern 90. Thus, the upper and lower wax gating arms 126 and 128 are completely enclosed by the ceramic mold material 40 (see FIG. 9). Of course, all of the other components of the wax gating pattern 90 are also enclosed with the ceramic mold material 40.

After the ceramic mold material 40 has at least partially dried, the mold 42 is heated to melt the wax material of the inner and outer shroud ring patterns 34 and 38 and the wax gating pattern 90. The melted wax is poured out of the mold 42 through an open end of a combination pour cup and downpole formed by the pour cup and downpole pattern 120 of FIG. 7. This results in inner and outer shroud ring mold cavities 44 and 46 being connected with a combination downpole and pour cup having a configuration corresponding to the downpole and pour cup pattern 120 by passages corresponding to the configuration of the wax gating patterns A pair of gating passages 144 and 146 having configurations corresponding to the configurations of the wax gating arms 126 and 128 are connected with the upper and lower end portions of the outer shroud ring mold cavity 46. Although only the gating passages 144 and 146 have been shown in FIG. 11, other gating passages are connected with the upper and lower end portions of the outer shroud ring mold cavity 46. Gating passages are also connected with the upper and lower end portions of the inner shroud ring mold cavity 44.

The mold 42 is then fired at a temperature of approximately 1900° F. for a time sufficient to cure the mold sections. This results in the airfoils 24 being securely fixed in place relative to the inner and outer shroud ring mold cavities 44 and 46 by the rigid ceramic mold material 40.

Once the mold 42 has been formed in the manner previously described, molten metal is poured into the mold through the pour cup and downpole. The molten metal flows through gating passages to the upper and lower end portions of the shroud ring mold cavities 44 and 46. Thus, the molten metal flows radially inwardly into the upper and lower end portions of the outer shroud ring mold cavity 46 through openings where the passages 144 and 146 (FIG. 11) are connected with the outer shroud ring mold cavity. Similarly, molten metal flows radially outwardly into the inner shroud ring mold cavity 44 through passages connected with the upper and lower end portions of the mold cavity. The molten metal also flows into both the inner and outer shroud ring mold cavities 44 and 46 through passages connected with the axially upper ends of the mold cavities.

While the molten metal is flowing into the shroud ring mold cavities 44 and 46, the airfoils are held against movement relative to each other and to the mold cavities by the ceramic mold material 40 engaging the major side surfaces 70 and 72 of the airfoils. The molten metal does not engage the ends 73 of the airfoils 24 since this ends are covered by the ceramic mold material 40. However, the molten metal in the inner and outer shroud ring mold cavities 44 and 46 goes completely around each of the airfoils 24 so that the end portions 32 and 36 of the airfoils are circumscribed by the molten metal.

Once the molten metal has been poured, the airfoils 24 act as a chill. Therefore, the molten metal solidifies in a direction extending transverse to the central axes of the airfoils 24. However, shrinkage defects are not formed in the axially upper and lower end portions of the inner and outer shroud ring mold cavities 44 and 46. This is because the gating passages are effective to maintain a supply of molten metal to the upper and lower end portions of the shroud ring mold cavities 44 and 46 as the molten metal in the shroud ring mold cavities solidifies.

During solidification of the molten metal in the shroud ring mold cavities 44 and 46, a metallurgical bond does not form between the inner and outer shroud rings 26 and 28 and the end portions 32 and 36 of the airfoils 24. This is because the outer surface of the airfoils 24 is covered with an oxide coating which is formed during handling of the airfoils in the atmosphere. This oxide coating prevents the forming of a metallurgical bond between the airfoils 24 and the inner and outer shroud rings 26 and 28. Therefore, there is only a mechanical bond between the inner and outer shroud rings 26 and 28 and the end portions 32 and 36 of the airfoils 24.

The molten metal which solidifies to form the inner and outer shroud rings 26 and 28 has a different composition than the composition of the airfoils 24. Thus, the airfoils 24 are formed of a nickel-chrome alloy. The inner and outer shroud rings 26 and 28 are formed of cobalt chrome superalloy, such as MAR M509. Although the shroud rings 26 and 28 are formed of the same metal, they could be formed of different metals if desired. If the shroud rings 26 and 28 are to be formed of different metals, two separate gating systems would have to be provided, that is, one gating system for the inner shroud ring mold cavity 44 and a second gating system for the outer shroud ring mold cavity 46. Of course, each gating system would have its own downpole and pour cup.

Accommodating Thermal Expansion

During use of the stator 20 (FIG. 1), the airfoils 24 are exposed to gas which comes directly from the combustion chamber. The airfoils 24 becomes hotter than the inner and outer shroud rings 26 and 28. Therefore, the airfoils tend to expand axially outwardly, that is in a radial direction relative to the shroud rings 26 and 28. In the absence of the slip joints 58 between each of the airfoils and the outer shroud ring 28, substantial thermal stresses would be set up in the airfoils and the inner and outer shroud rings.

When the inner and outer shroud rings 26 and 28 and airfoils 24 are at the same temperature, the slip joints 58 are tightly closed, in the manner illustrated schematically in FIG. 14. However, when the airfoils 24 are heated to a temperature which is above the temperature of the inner and outer shroud rings 26 and 28, the airfoils expand radially outwardly relative to the shroud rings. As this occurs, the slip joints 58 open, as shown schematically in FIG. 15. As the slip joints 58 open, the tapering side surfaces 66 and 68 on the outer end portions 36 of the airfoils 24 move away from similarly tapering inner side surfaces 152 and 154 on the inside of openings 156 in the outer shroud ring 28.

Figure 15:
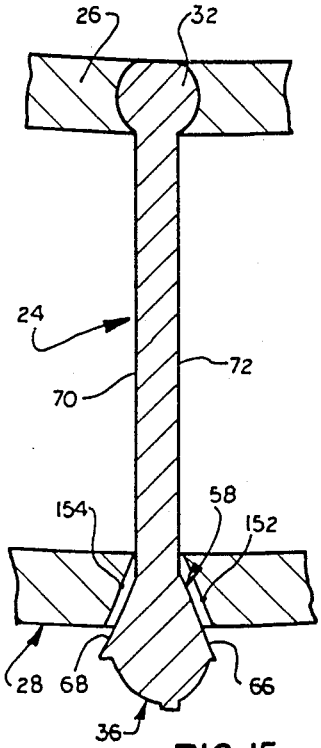
FIG. 15 is a fragmentary sectional view, generally similar to FIG. 14, illustrating the manner in which thermal expansion of the airfoil opens a slip joint between the airfoil and outer shroud ring.

The slip joints 58 can readily move from the closed condition of FIG. 14 to the open condition of FIG. 15 under the influence of thermal expansion forces since there is no metallurgical bond between the outer shroud ring 28 and the end portion 36 of the airfoil 24. This is due to the oxide coatings which covers the end portions 36 of the airfoils before molten metal is poured into the shroud ring mold cavity. It should be noted that the inner end portion 32 of each airfoil 24 is mechanically anchored in the inner shroud ring 26. This prevents the airfoils 24 from moving out of engagement with the inner shroud ring 26 as the slip joints 58 open.

Although the slip joints 58 have been shown herein as being between the end portion 36 of the airfoil and the outer shroud ring 28, it is contemplated that the slip joint could be provided between the inner end portion 32 of the airfoil 24 and the inner shroud ring 26. If this was done, the outer end portion 36 of the airfoil would be mechanically anchored in the outer shroud ring 28. It is also contemplated that in certain types of turbine engine components it may be desirable to have slip joints formed between the airfoil 24 and both the inner and outer shroud rings 26 and 28. If this was done, the inner end portion 32 of the airfoil 24 would be tapered radially outwardly so that the end portion 32 of the airfoil could move inwardly of the inner shroud ring 26 in much the same manner as in which the outer end portion 36 of the airfoil 24 moves outwardly of the outer shroud ring 28.

In the illustrated embodiment of the invention, the inner and outer shroud rings 26 and 28 are positioned in a concentric relationship with the airfoils 24 disposed in a radially extending annular array between the shroud sections. In certain known turbine engine components, the shroud rings have the same diameter and the airfoils extend in an axial direction between the shroud rings. Of course, these shroud rings could be cast around preformed airfoils in much the same way as in which the shroud rings 26 and 28 are cast around the airfoils 24. It is contemplated that suitable slip joints could also be provided between the airfoils and shroud rings in this type of turbine engine component.

Although the invention is advantageously practiced in conjunction with the formation of a slip joint 58 between the airfoils 24 and the inner and outer shroud rings 26 and 28, it is contemplated that inner and outer end portions 32 and 36 of the airfoils 24 may be firmly anchored in both the inner shroud ring 26 and the outer shroud ring 28. If this were done, both the inner shroud ring 26 and the outer shroud ring 28 would be cast around the outer end portions of the airfoils in the same manner as described herein for the inner shroud ring 26. Of course, this would require that thermal expansion of the airfoils be accommodated in a method other than by the provision of a slip joint similar to the slip joint 58.

Conclusion

The present invention relates to a turbine engine component 20 having a plurality of airfoils 24 disposed in an annular array 22 between inner and outer shroud rings 26 and 28. In making the turbine engine component 20, airfoils 24 are placed in an annular array with the end portions 32 and 36 of the airfoils 24 embedded in wax inner and outer shroud ring patterns 34 and 38. After a wax gating pattern 90 has been connected with the wax shroud ring patterns 34 and 38, the entire assembly is covered with ceramic mold material 40 to form a mold 42. The wax of the shroud ring and gating patterns 34, 38 and 90 is then removed to leave inner and outer shroud ring mold cavities 44 and 46 in which the inner and outer end portions 32 and 36 of the airfoils 24 are disposed.

The inner and outer shroud ring mold cavities 44 and 46 are then filled with molten metal which encloses the end portions 32 and 36 of the airfoils 24. During the filling of the shroud ring mold cavities 44 and 46 with molten metal, the airfoils 24 are held in a selected spatial relationship with the shroud ring mold cavities 44 and 46 by the ceramic mold material 40. Once the molten metal in the inner and outer shroud ring mold cavities 44 and 46 has solidified, the turbine engine component 22 is removed from the mold 42.

In order to minimize thermal stresses during use of the turbine engine component 20, slip joints 58 are provided between the airfoils 24 and a shroud ring 28 to accommodate thermal expansion of the airfoils relative to the shroud rings. Thus, one end 32 of each of the airfoils 24 is anchored in one of the shroud rings 26 while slip joints 58 are provided between the airfoils 24 and the other shroud ring 28. When the airfoils 24 are heated to a temperature above the temperature of the shroud rings 26 and 28, thermal expansion of the airfoils 24 cause the slip joints 58 to open.

In order to optimize the operating characteristics of the turbine engine component 20, the shroud rings 26 and 28 and airfoils 24 may be formed of metals having different metallurgical compositions and different crystallographic structures. Thus, the shroud rings 26 and 28 may be formed of a metal which is different than a metal of the airfoils 24. Also, the shroud rings 26 and 28 may be formed of metals which are both different than the metal of the airfoils 24. Similarly, the airfoils 24 may be formed with either a single crystal or columnar grained crystallographic structure.

Having described specific preferred embodiments of the invention, the following is claimed:

1. A method of making a turbine engine component having a plurality of airfoils disposed in an annular array between inner and outer shroud rings, said method comprising the steps of positioning a plurality of airfoils having leading and trailing edge portions extending between inner and outer end portions of the airfoils in an annular array with outer end portions of the airfoils at least partially embedded in an outer shroud ring formed of wax and with inner end portions of the airfoils at least partially embedded in an inner shroud ring formed of wax, covering the airfoils and wax shroud rings with ceramic mold material to form a mold, removing the wax material of the shroud rings from the mold to leave inner and outer shroud ring mold cavities having configurations corresponding to the configurations of the wax shroud rings, the inner and outer end portions of the airfoils being at least partially disposed in the shroud ring mold cavities, filling the inner and outer shroud ring mold cavities with molten metal, said step of filling the inner and outer shroud ring mold cavities with molten metal including the steps of at least partially enclosing the inner end portions of the airfoils with a first annular body of molten metal having a configuration corresponding to the configuration of the inner shroud ring and at least partially enclosing the outer end portions of the airfoils with a second annular body of molten metal having a configuration corresponding to the configuration of the outer shroud ring, holding the airfoils in a predetermined spatial relationship with the inner and outer shroud ring mold cavities during filling of the shroud ring mold cavities with molten metal by engaging the airfoils with the ceramic mold material, and solidifying the molten metal in the inner and outer shroud ring mold cavities to form the inner and outer shroud rings, said step of solidifying the molten metal including solidifying the molten metal in the inner shroud ring mold cavity around the inner end portions of the airfoils and solidifying the molten metal in the outer shroud ring mold cavity around the outer end portions of the airfoils.

2. A method as set forth in claim 1 wherein said step of filling the inner and outer shroud ring mold cavities with molten metal includes filling the inner and outer shroud ring mold cavities with molten metal having a metallurgical composition which is different than a metallurgical composition of the airfoils.

3. A method as set forth in claim 1 wherein said step of positioning a plurality of airfoils includes positioning airfoils having a first metallurgical composition, said step of filling the inner and outer shroud ring mold cavities with molten metal includes filling the inner shroud ring mold cavity with molten metal having a second metallurgical composition which is different than said first metallurgical composition and filling the outer shroud ring mold cavity with molten metal having a third metallurgical composition which is different than said first and second metallurgical compositions.

4. A method as set forth in claim 1 wherein said step of filling the inner and outer shroud ring mold cavities with molten metal is performed with a central axis of the shroud ring mold cavities in an upright orientation and includes directing molten metal through openings in an axially lower end portion of a radially outer side surface of the outer shroud ring mold cavity to prevent the formation of defects due to a lack of sufficient molten metal in the axially lower end portion of the outer shroud ring mold cavity during solidification of the molten metal in the outer shroud ring mold cavity.

5. A method as set forth in claim 1 wherein said step of solidifying molten metal in the shroud ring mold cavities includes leaving joints between the end portions of the airfoils and the solidified metal in at least one of the shroud ring mold cavities free of metallurgical bonds to enable thermal expansion to occur between the airfoils and at least one of the shroud rings during use of the turbine engine component.

6. A method as set forth in claim 1 wherein said step of positioning the airfoils in an annular array with the end portions of the airfoils at least partially embedded in wax shroud rings includes leaving an end surface area on one end portion of each of the airfoils exposed, the exposed end surface area on the one end portion of each of the airfoils being at least as great as a maximum cross sectional area of the one end portion as viewed in a plane extending perpendicular to a central axis of the airfoil.

7. A method as set forth in claim 1 wherein the outer end portion of each of the airfoils tapers outwardly from a relatively small cross sectional area to a maximum cross sectional area, said step of positioning the airfoils in an annular array with the outer end portions of the airfoils at least partially embedded in the outer wax shroud ring includes leaving an outer end surface area on the outer end portion of each of the airfoils exposed, the exposed outer end surface area on the outer end portion of each of the airfoils having a cross sectional area which is as great as the maximum cross sectional area of the outer end portion of the airfoil.

8. A method as set forth in claim 7 wherein said step of solidifying the molten metal in the outer shroud ring mold cavity around the outer end portions of the airfoils includes leaving the outer end surface area on the outer end portions of each of the airfoils exposed.

9. A method as set forth in claim 1 further including establishing covering which inhibits the forming of metallurgical bonds over the outer end portions of the airfoils prior to performing said step of filling the shroud ring mold cavities with molten metal, said step of solidifying the molten metal in the outer shroud ring mold cavity including solidifying the molten metal in the outer shroud ring mold cavity and inhibiting forming metallurgical bonds between the outer end portions of the airfoils and the solidified metal with the covering.

10. A method as set forth in claim 1 wherein said step of filling the outer shroud ring mold cavity with molten metal includes the steps of conducting molten metal into the outer shroud ring mold cavity at a plurality of locations disposed above the airfoils and conducting molten metal into the outer shroud ring mold cavity at a plurality of locations disposed below the airfoils.

11. A method as set forth in claim 1 wherein said step of positioning the airfoils in an annular array with end portions of the airfoils embedded in wax shroud rings includes molding segments of the wax inner shroud ring around the inner end portions of the airfoils, molding segments of the wax outer shroud ring around the outer end portions of the airfoils, interconnecting the wax segments of the inner shroud ring, and interconnecting the wax segments of the outer shroud ring.

12. A method as set forth in claim 1 wherein said step of positioning the airfoils in an annular array includes positioning the airfoils to extend radially outwardly from the inner shroud ring to the outer shroud ring.

13. A turbine engine component comprising an annular one-piece outer shroud ring, said outer shroud ring having a plurality of openings defined by inwardly tapering surfaces of said outer shroud ring, an annular one-piece inner shroud ring being disposed in a coaxial relationship with the outer shroud ring, a plurality of airfoils having inner end portions connected with said inner shroud ring and outer end portions connected with said outer shroud ring, means for interconnecting said inner end portions of said airfoils and said inner shroud ring to hold the airfoils against movement relative to said inner shroud ring, said outer end portion of said airfoils having side surfaces which taper inwardly and are disposed in abutting engagement with the inwardly tapering inner side surfaces of said outer shroud ring when said airfoils and outer shroud ring are at the same temperature, said airfoils being thermally expandable in outward directions relative to said outer shroud ring to move the tapered side surfaces on the outer end portions of the airfoils out of engagement with the inwardly tapering surfaces of said outer shroud ring upon heating of the aifoils to a temperature above the temperature of the outer shroud ring.

14. A method comprising the steps of providing a turbine engine component having a plurality of airfoils extending between inner and outer shroud rings, heating the airfoils to a temperature above the temperature of the outer shroud ring, thermally expanding the airfoils in an outer direction relative to the outer shroud ring during performance of said step of heating the airfoils, and moving tapered surfaces on outer end portions of the airfoils out of engagement with tapered surfaces on the outer shroud ring during performance of said step of thermally expanding the airfoils.

15. A method as set forth in claim 14 wherein said step of filling the outer shroud ring mold cavity with molten metal includes the steps of conducting molten metal into the outer shroud ring mold cavity at a plurality of locations disposed above the airfoils and conducting molten metal into the outer shroud ring mold cavity at a plurality of locations disposed below the airfoils.

16. A metod as set forth in claim 15 wherein said step of positioning the airfoils in an annular array includes positioning the airfoils to extend radially outwardly from the inner shroud ring to the outer shroud ring.

17. A method of making a metal turbine engine component having a plurality of metal airfoils disposed in an annular array between inner and outer shroud rings, said method comprising the steps of positioning a plurality of metal airfoils having leading and trailing edge portions extending between inner and outer end portions of the metal airfoils in an annular array with outer end portions of the metal airfoils at least partially embedded in an outer shroud ring formed of wax and with inner end portions of the metal airfoils at least partially embedded in an inner shroud ring formed of wax, said step of positioning the metal airfoils in an annular array with end portions of the airfoils embedded in wax shroud rings includes molding segments of the wax inner shroud ring around inner end portions of the metal airfoils, molding segments of the wax outer shroud ring around outer end portions of the metal airfoils, placing the wax segments of the inner shroud ring in an annular array, placing the wax segments of the outer shroud ring in an annular array, interconnecting the wax segments of the inner shroud ring, and interconnecting the wax segments of the outer shroud ring, said steps of interconnecting the wax segments of the inner and outer shroud rings being performed with the metal airfoils extending between the wax segments of the inner and outer shroud rings, covering the metal airfoils and wax shroud rings with ceramic mold material to form a mold, removing the wax material of the shroud rings from the mold to leave inner and outer shroud ring mold cavities having configuration corresponding to the configurations of the wax shroud rings, the inner and outer end portions of the metal airfoils being at least partially disposed in the shroud ring mold cavities, filling the inner and outer shroud ring mold cavities with molten metal, said step of filling the inner and outer shroud ring mold cavities with molten metal including the steps of at least partially enclosing the inner end portions of the metal airfoils with a first annular body of molten metal having a configuration corresponding to the configuration of the inner shroud ring and at least partially enclosing the outer end portions of the metal airfoils with a second annular body of molten metal having a configuration corresponding to the configuation of the outer shroud ring, and solidifying the molten metal in the inner and outer shroud ring mold cavities to formm the inner and outer shroud ring, said step of solidifying the molten metal including solidifying the molten metal in the inner shroud ring mold cavity around the inner end portions of the metal airfoils and solidifying the molten metal in the outer shroud ring mold cavity around the outer end portions of the metal airfoils.

18. A method as set forth in claim 17 wherein said step of at least partially enclosing outer end portions of the metal airfoils with a second annular body of molten metal includes conducting molten metal into the outer shroud ring mold cavity at a plurality of locations disposed above the metal airfoils and conducting molten metal into the outer shroud ring mold cavity at a plurality of locations disposed below the metal airfoils.

19. A method as set forth in claim 17 wherein said step of filling the inner and outer shroud ring mold cavities with molten metal is performed with a central axis of the shroud ring mold cavities in an upright orientation and includes directing molten metal through openings in an axially lower end portion of the outer shroud ring mold cavity and directing molten metal through openings in an axially upper end portion of the outer shroud ring cavity to prevent the formation of defects due to a lack of sufficient moltent metal in the axially upper and lower end portions of the outer shroud ring mold cavity during solidification of the molten metal in the outer shroud ring mold cavity.

20. A method as set forth in claim 17 wherein said step of solidifying molten metal in the shroud ring mold cavities includes leaving joints between the end portions of the airfoils and the solidified metal in at least one of the shroud ring mold cavities free of metallurgical bonds to enable thermal expansion to occur between the airfoils and at least one of the shroud rings during use of the turbine engine component.

21. A method as set forth in claim 17 wherein said step of positioning the airfoils in an annular array with the end portions of the airfoils at least partially embedded in wax shroud rings includes leaving an end surface area on one end portion of each of the airfoils exposed, the exposed end surface area on the one end portion of each of the airfoils being at least as great as maximum cross sectional area of the one end portion as viewed in a plane extending perpendicular to a central axis of the airfoil.

22. A method as set forth in claim 17 wherein the outer end portion of each of the airfoils tapers outwardly from a relatively small cross sectional area to a maximum cross sectional area, said step of positioning the airfoils in an annular array with the outer end portions of the airfoils at least partially embedded in the outer wax shroud ring includes leaving an outer end surface area on the outer end portion of each of the airfoils exposed, the exposed outer end surface area on the outer end portion of each of the airfoils having a cross sectional area which is as great as the maximum cross sectional area of the outer end portion of the airfoil.

23. A method as set forth in claim 22 wherein said step of solidifying the molten metal in the outer shroud ring mold cavity around the outer end portions of the airfoils includes leaving the outer end surface area on the outer end portions of each of the airfoils exposed.

24. A method as set forth in claim 17 further including the step of holding the metal airfoils in a predetermined spatial relationship with the inner and outer shroud ring mold cavities during filling of the shroud ring mold cavities with molten metal by engaging the airfoils with the ceramic mold material.

25. A method of making a metal turbine engine component having a plurality of metal airfoils disposed in an annular array between inner and outer shroud rings, said method comprising the steps of positioning a plurality of metal airfoils having leading and trailing edge portions extending between inner and outer end portions of the metal airfoils in an annular array with outer end portions of the metal airfoils at least partially embedded in an annular outer shroud ring formed of wax and with inner end poritons of the metal airfoils at least partially embedded in an annular inner shroud ring formed of wax, covering the metal airfoils and wax shroud rings with ceramic mold material to form a mold, removing the wax material of the shroud rings from the mold to leave coaxial inner and outer shroud ring mold cavities having annular configurations corresponding to the configurations of the wax shroud rings, the inner and outer end portions of the metal airfoils being at least partially disposed in the shroud ring mold cavities, filling the inner and outer shroud ring mold cavities with molten metal while the central axis of the annular shroud ring mold cavities is in an upright orientation, said step of filling the inner and outer shroud ring mold cavities with molten metal including the steps of at least partially enclosing the inner end portions of the metal airfoils with a first annular body of molten metal having a configuration corresponding to the configuration of the inner shroud ring, directing molten metal through openings in an axially lower end portion of the outer shroud ring mold cavity, directing molten metal through openings in an axially upper end portion of the outer shroud ring mold cavity, and at least partially enclosing the outer end portions of the metal airfoils with a second annular body of molten metal having a configuration corresponding to the configuration of the outer shroud ring, and solidifying the molten metal in the inner and outer shroud ring mold cavities to form the inner and outer shroud rings, said step of solidifying the molten metal including solidifying the molten metal in the inner shroud ring mold cavity around the inner end portions of the metal airfoils and solidifying the molten metal in the outer shroud ring mold cavity around the outer end portions of the metal airfoils and then in directions extending upwardly and downwardly from the outer end portions of the metal airfoils toward the openings in the axially upper and lower end portions of the outer shroud ring mold cavity to prevent the formation of defects due to a lack of sufficient molten metal in the axially upper and lower end portions of the outer shroud ring mold cavities during solidification of the molten metal in the outer shroud ring mold cavity.

26. A method as set forth in claim 25 wherein said step of filling the inner and outer shroud ring mold cavities with molten metal includes filling the inner and outer shroud ring mold cavities with molten metal having a metallurgical composition which is different than metallugical composition of the metal airfoils.

27. A method as set foth in claim 25 wherein said step of positioning a plurality of airfoils includes positioning airfoils having a first metallurgical composition, said step of filling the inner and outer shroud ring mold cavities with molten metal includes filling the inner shroud ring mold cavity with molten metal having a second metallurigical composition which is different than said fist metallurgical composition and filling the outer shroud ring mold cavity with molten metal having a third metallurgical composition which is different than said first and second metallurgical compositions.

28. A method as set forth in claim 25 wherein said step of solidifying molten metal in the shroud ring mold cavities includes leaving joints between the end portions of the metal airfoils and the solidified metal in at least one of the shroud ring mold cavities free of metallurgical bonds to enable thermal expansion to occur between the metal airfoils and at least one of the shroud rings during use of the turbine engine component.

29. A method as set forth in claim 25 wherein said step of positioning the airfoils in an annular array with the end portions of the airfoils at least partially embedded in wax shroud rings includes leaving an end surface area on one end portion of each of the airfoils exposed, the exposed end surface area on the one end portion of each of the airfoils being at least as great as a maximum cross sectional area of the one end portion as viewed in a plane extending perpendicular to a central axis of the airfoil.

30. A method as set forth in claim 25 wherein the outer end portion of each of the airfoils tapers outwardly from a relatively small cross sectional area to a maximum cross sectional area, said step of positioning the airfoils in an annular array with the outer end portions of the airfoils at least partially embedded in the outer wax shroud ring includes leaving an outer end surface on the outer end portion of each of the airfoils exposed, the exposed outer end surface area on the outer end portion of each of the airfoils having a cross sectional area which is as great as the maximum cross sectional area of the outer end portion of the air foil.

31. A metod as set forth in claim 30 wherein said step of solidifying the molten metal in the outer shroud ring mold cavity around the outer end portions of the airfoils includes leaving the outer end surface area on the outer end portions of each of the airfoils exposed.

32. A method as set forth in claim 25 further including establishing covering which inhibits the forming of metallurgical bonds over the outer end portions of the airfoils prior to performing said step of filling the shroud ring mold cavities with molten metal, said step of solidifying the molten metal in the outer shroud ring mold cavity including solidifying the molten metal in the outer shroud ring mold cavity and inhibiting forming metallurgical bonds between the outer end portions of the airfoils and the solidified metal with the covering.

33. A method as set forth in claim 25 wherein said step of positioning the airfoils in an annular array with end portions of the airfoils embedded in wax shroud rings includes molding segments of the wax inner shroud ring around the inner end portions of the airfoils, molding segments of the wax outer shroud ring around the outer end portions of the airfoils, interconnecting the wax segments of the inner shroud ring, and interconnecting the wax segments of the outer shroud ring.

34. A method as set forth in claim 25 further including the step of holding the metal airfoils in a predetermined spatial relationship with the inner and outer shroud ring mold cavities during filling of the shroud ring mold cavities with molten metal by engaging the airfoils with the ceramic mold material.

* * * * *

UNITED STATES PATENT AND TRADEMARK OFFICE

CERTIFICATE OF CORRECTION

PATENT NO. : 4,728,258

DATED : March 1, 1988

INVENTOR(S) : William S. Blazek and Jerry L. Hasch

It is certified that error appears in the above-identified patent and that said Letters Patent is hereby corrected as shown below:

Column 13, delete lines 56 through 68, column 14, delete lines 1 through 21 and insert thereat:

13. A turbine engine component having a plurality of airfoils disposed in an annular array between inner and outer shroud rings, said turbine engine component being made by a process comprising the steps of providing a plurality of metal airfoils having leading and trailing edge portions extending between inner and outer end portions of the airfoils, positioning the metal airfoils in an annular array with outer end portions of the airfoils at least partially embedded in an outer shroud ring formed of wax and with inner end portions of the airfoils at least partially embedded in an inner shroud ring formed of wax, covering the metal airfoils and wax shroud rings with ceramic mold material to form a mold, removing the wax material of the shroud rings from the mold to leave inner and outer shroud ring mold cavities having configurations corresponding to the configurations of the wax shroud rings, the inner and outer end portions of the metal airfoils being at least partially disposed in the shroud ring mold cavities, filling the inner and outer shroud ring mold cavities with molten metal, said step of filling the inner and outer shroud ring mold cavities with molten metal including the steps of at least partially enclosing the inner end portions of the metal airfoils with a first annular body of molten metal having a configuration corresponding to the configuration of the inner shroud ring and at least partially enclosing the outer end portions of the metal airfoils with a second annular body It is certified that error appears in the above-identified patent and that said Letters Patent is hereby corrected as shown below:

of molten metal having a configuration corresponding to the configuration of the outer shroud ring, holding the metal airfoils in a predetermined spatial relationship with the inner and outer shroud ring mold cavities during filling of the shroud ring mold cavities with molten metal by engaging the metal airfoils with the ceramic mold material, and solidifying the molten metal in the inner and outer shroud ring mold cavities to form the inner and outer shroud rings, and said step of solidifying the molten metal including solidifying the molten metal in the inner shroud ring mold cavity around the inner end portions of the metal airfoils and solidifying the molten metal in the outer shroud ring mold cavity around the outer end portions of the metal airfoils.

14. A method of making a turbine engine component having a plurality of airfoils disposed in an annular array between inner and outer shroud rings, said method comprising the steps of providing a plurality of airfoils having leading and trailing edge portions extending between inner and outer end portions of the airfoils, positioning the airfoils in an annular array, covering the airfoils with ceramic mold material, forming inner and outer shroud ring mold cavities, filling the inner and outer shroud ring mold cavities with molten metal, holding the airfoils in a predetermined spatial relationship with the inner and outer shroud ring mold cavities during filling of the shroud ring mold cavities with molten metal by engaging the airfoils with the ceramic mold

UNITED STATES PATENT AND TRADEMARK OFFICE

CERTIFICATE OF CORRECTION

PATENT NO. : 4,728,258

DATED : March 1, 1988

INVENTOR(S) : William S. Blazek and Jerry L. Hasch

It is certified that error appears in the above-identified patent and that said Letters Patent is hereby corrected as shown below:

material and solidifying the molten metal in the inner and outer shroud ring mold cavities to form the inner and outer shroud rings.

Signed and Sealed this

Seventh Day of November, 1989

*Attest:*

JEFFREY M. SAMUELS

*Attesting Officer*

*Acting Commissioner of Patents and Trademarks*